US005848500A

United States Patent [19]

Kirk

[11] Patent Number: 5,848,500

[45] Date of Patent: Dec. 15, 1998

[54] LIGHT-TIGHT ENCLOSURE AND JOINT CONNECTORS FOR ENCLOSURE FRAMEWORK

[75] Inventor: Duane B. Kirk, Hilton, N.Y.

[73] Assignee: Eastman Kodak Company, Rochester, N.Y.

[21] Appl. No.: 780,477

[22] Filed: Jan. 7, 1997

[51] Int. Cl.[6] ..... E04H 1/00

[52] U.S. Cl. ..... 52/79.1; 52/280; 52/63; 52/656.9; 403/231; 403/217; 160/135; 312/265.1

[58] Field of Search ..... 52/79.1, 63, 222, 52/273, 656.9, 280; 160/135; 403/231, 217, 218, 176; 312/265.1, 265.2, 265.4

[56] References Cited

U.S. PATENT DOCUMENTS

| | | | |
|---|---|---|---|
| 2,220,373 | 11/1940 | Krauser et al. . | |
| 2,956,705 | 10/1960 | Clingman . | |
| 3,371,454 | 3/1968 | Anderson . | |
| 3,784,043 | 1/1974 | Presnick | 52/656.9 |
| 3,811,767 | 5/1974 | Purnell . | |
| 3,901,612 | 8/1975 | Canin | 52/656.9 X |
| 4,057,941 | 11/1977 | Schwartz | 52/63 |
| 4,071,990 | 2/1978 | Traber | 403/231 X |
| 4,159,171 | 6/1979 | Nineberg . | |
| 4,434,900 | 3/1984 | Cook | 160/135 X |
| 4,619,547 | 10/1986 | Renaud-Goud | 403/231 |
| 4,652,170 | 3/1987 | Lew | 403/217 X |
| 4,860,778 | 8/1989 | Pohl | 52/63 X |
| 4,891,923 | 1/1990 | Ericsson et al. . | |
| 5,224,306 | 7/1993 | Cramer | 52/63 |
| 5,481,842 | 1/1996 | Gautreau | 52/656.9 |
| 5,537,795 | 7/1996 | Dias | 160/135 X |
| 5,546,718 | 8/1996 | Way | 160/135 X |
| 5,596,843 | 1/1997 | Watson | 52/63 X |

*Primary Examiner*—Winnie S. Yip
*Attorney, Agent, or Firm*—Susan L. Parulski

[57] ABSTRACT

In a light-tight enclosure, elongate members and joint connectors are joined to one another to form a framework to which panels having projecting ribs with right-angled corners are mounted. Each elongate member is extruded from aluminum so as to have open ended grooves. Each joint connector is fabricated from aluminum so as to have open ended grooves, some of which have right-angled corners conforming to right-angled corners of the projecting ribs. At each joint where elongate members and a joint connector are joined, the open-ended grooves merge with one another so as to define continuously extending grooves receiving the projecting ribs of the panels mounted to the framework at the joint. Some joint connectors are employed as corner connectors while other joint connectors are employed as edge connectors.

10 Claims, 9 Drawing Sheets

LIGHT-TIGHT ENCLOSURE AND JOINT CONNECTORS FOR ENCLOSURE FRAMEWORK

TECHNICAL FIELD OF THE INVENTION

This invention pertains generally to a light-tight enclosure comprising a framework and panels mounted to the framework and to joint connectors useful in the enclosure. The framework is constructed from elongate members, which may be extruded members, and joint connectors, which include corner connectors and edge connectors.

BACKGROUND OF THE INVENTION

In the manufacture of light-sensitive products, such as photographic film, it is known to enclose the manufacturing equipment in a light-tight enclosure so that the equipment operator can work in white light, outside the light-tight enclosure. Conventionally, a light-tight enclosure is constructed from elongate metal sections joined to one another to form a framework, and from panels mounted to the framework. Some panels are doors that are hinged to the framework.

In a light-tight enclosure of the type noted above, each metal section is machined from a metal bar or formed from a metal sheet, so as to have a groove extending along an outer surface of such elongate section and mating with a groove of an adjacent section. If machined from a metal bar, each elongate section is screwed or welded to other elongate sections. If formed from a metal sheet, each elongate section is welded to other elongate sections. Generally, since each elongate section may be uniquely fabricated, fixturing is necessary to maintain squareness at right-angled corners, to insure that the grooves mate where necessary, and to insure that the doors and other panels fit properly.

Fabrication and assembly of a light-tight enclosure of the type noted above tends to be quite expensive and time consuming and to require high levels of skill from fabricators and assemblers. There is a need for improvements whereby fabrication and assembly of a light-tight enclosure are simplified.

SUMMARY OF THE INVENTION

This invention provides improvements in a light-tight enclosure comprising a framework and panels mounted to the framework. Some panels may be doors hinged to the framework. Each panel has an outer rib projecting from one of its expansive surfaces and an inner rib projecting therefrom with each projecting rib having a right-angled corner. The framework includes elongate members and joint connectors, which include corner connectors and edge connectors. This invention permits each elongate member to be advantageously extruded from a suitable material, such as aluminum, and each elongate member is cut to a desired length from the extruded material but does not have to be uniquely fabricated.

Aluminum extrusions of commercially available types may be advantageously employed for the elongate members. Each elongate member has two grooved surfaces and is provided with at least one groove at each such surface. Each groove extends between the opposite ends of each elongate member and has two open ends. Each elongate member is joined at one of its opposite ends, as by screws, to one of the joint connectors.

Each joint connector is fabricated from a suitable material, such aluminum, as by machining an aluminum block. If employed along an edge of the framework, each joint connector has two grooved surfaces. If employed at a three-way corner of the framework, either an inside corner or an outside corner, each joint connector has three grooved surfaces. In either instance, each joint connector is provided at each grooved surface with at least one outwardly facing groove, which has two open ends and is continuous between the ends and which has an angled corner conforming to the angled corner of the projecting rib of one such panel.

This invention provides two basic types of joint connectors, a first type suitable for an outside corner where three elongate members defining right angles to one another and a joint connector are joined and a second type where a first, a second, and a third of the elongate members and a joint connector of a second type are joined with the first and second elongate members being aligned with the same axis and with the third elongate member extending at a right angle to the first and second elongate members. It is convenient to refer to a joint connector of the first type as a corner connector and to refer to a joint connector of the second type as an edge connector.

Each corner connector has three outwardly facing surfaces and being provided at each of its outwardly facing surfaces with a continuously extending groove, which is open-ended and which has a right-angled corner. Each edge connector has a first grooved surface and a second grooved surface at a right angle to the first grooved surface. Each edge connector is provided at its first grooved surface with a first continuously extending groove, which is open-ended and straight. Each edge connector is provided at its second surface with a continuously extending second groove, which is open-ended and which has a right-angled corner, and with a continuously extending third groove, which is open-ended and which has a right-angled corner.

At a corner connector in the assembled enclosure, three elongate members extend at right angles to one another and are joined to the corner connector, the grooves of the elongate members receive the outer ribs of three panels. Moreover, the right-angled corners of the grooves at the outwardly extending surfaces of the corner connector receive the right-angled corners of the outer ribs of the same panels. Furthermore, the inner ribs of said three panels project along the inwardly facing surfaces of the same elongate members.

At an edge connector in the assembled enclosure, a first elongate member and a second elongate member are joined to the edge connector and are aligned with the same axis, while a third elongate member is joined to the edge connector and extends at right angles to the first and second elongate members. Moreover, one of the grooves of the first elongate member, the first groove of the edge connector, and one of the grooves of the second elongate member receive the straight section of the outer rib of a first said panel. Moreover, the right-angled corner of the second groove of the edge connector receives the right-angled corner of the outer rib of a second said panel and the right-angled corner of the third groove of the edge connector receives the right-angled corner of the outer rib of a third said panel. Furthermore, the inner ribs of the first, second, and third panels project along the inwardly facing surfaces of the first, second, and third elongate members.

These and other objects, features, and advantages of this invention are evident from the following description of a preferred embodiment of this invention with reference to the accompanying drawings.

DETAILED DESCRIPTION OF THE PREFERRED EMBODIMENT

Figure 1:
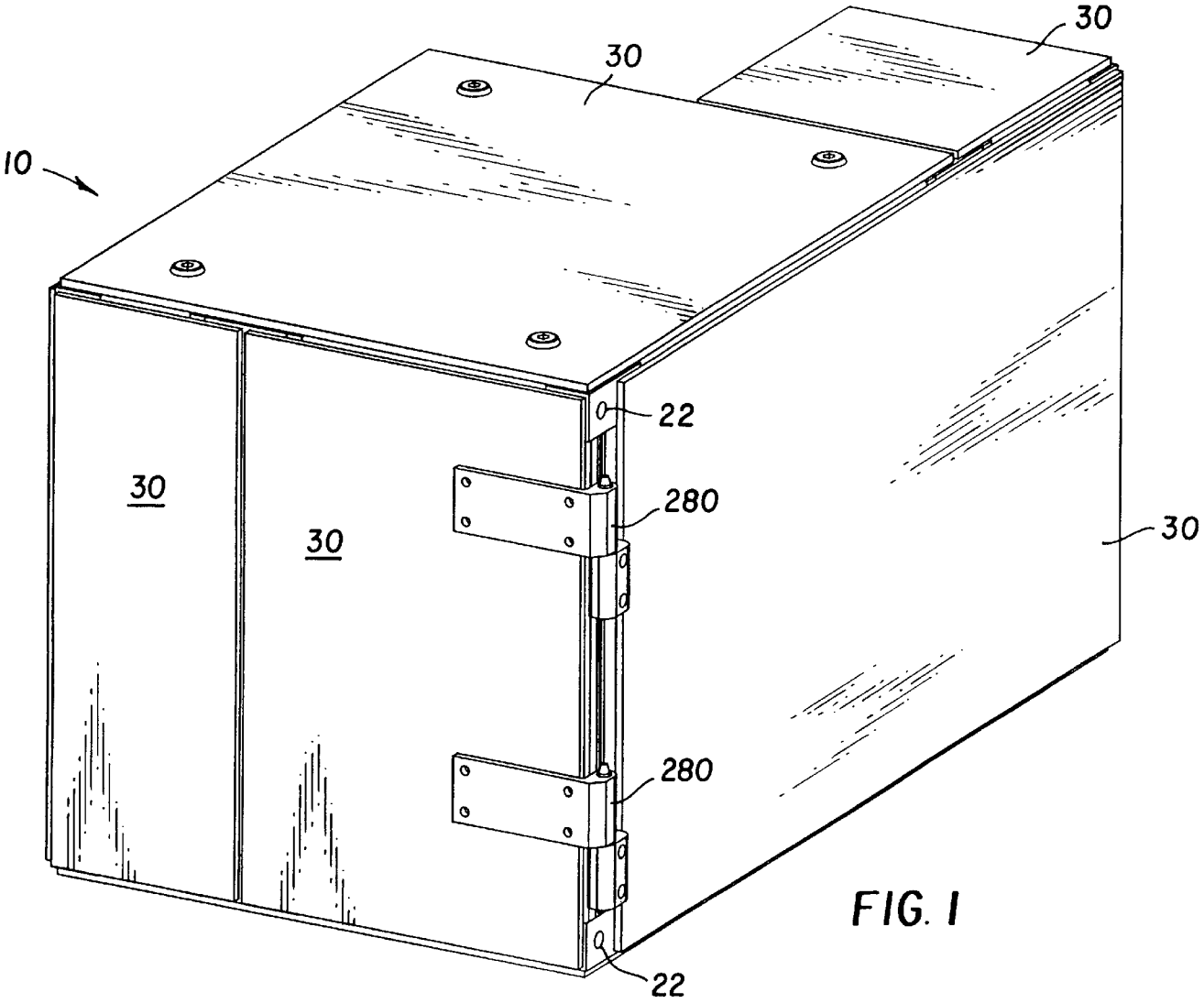
FIG. 1 is a perspective view of a light-tight enclosure comprising a framework and panels mounted to the framework and constituting a preferred embodiment of this invention, as seen from a first vantage.
Figure 2:
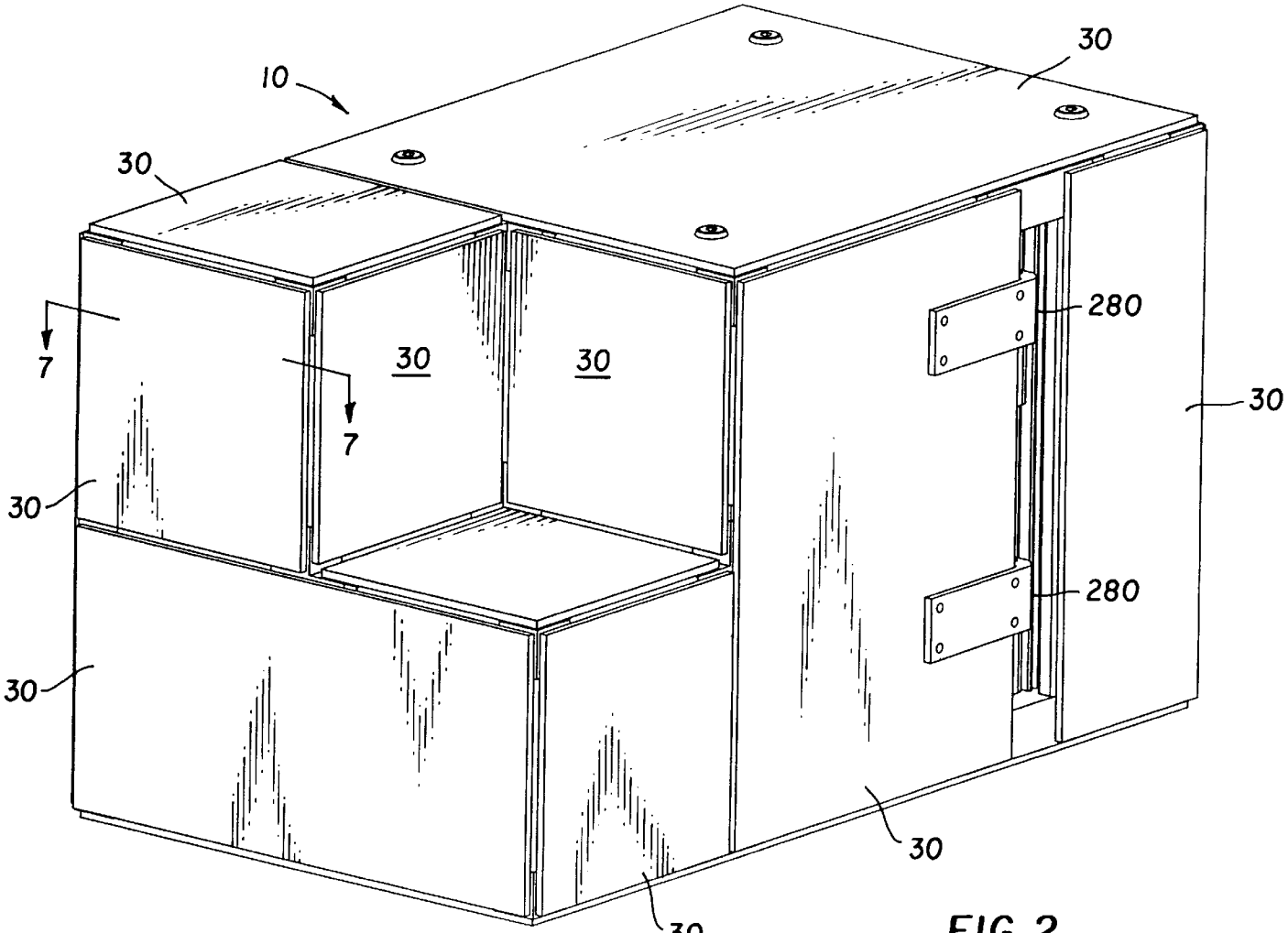
FIG. 2 is a perspective view of the light-tight enclosure, as seen from a second vantage.

As shown in the drawings, a light-tight enclosure 10 constitutes a preferred embodiment of this invention. The light-tight enclosure 10 may be advantageously employed in the manufacture of light-sensitive products, such as photographic film, so that the equipment operator can work in white light, outside the light-tight enclosure 10. The light-tight enclosure 10 comprises a framework 20 and panels 30 mounted to the framework 20. This invention permits the framework 20 to be easily assembled from elongate members, which include single-width, elongate members 40 and double-width, elongate members 60, and from joint connectors, which include corner connectors 80 and edge connectors 110. The framework 20 is assembled via machine screws 22 having heads and threaded shanks. A suitable sealant, such as a silicone sealant, or a suitable gasket is interposed at each of the joints between the elongate members and the joint connectors so as to prevent light leakage.

Preferably, the elongate members 40, 60, are aluminum extrusions, which are available commercially from various sources and which are cut to desired lengths. Aluminum extrusions available commercially from Alprofil Inc. Westbrook, Me., under Part No. 1-440 are suitable for the single-width, elongate members 40. Aluminum extrusions available commercially therefrom under Part No. 0-840 are suitable for the double-width, elongate members 60. Polymeric extrusions may be alternatively employed for the elongate members 40, 60.

Each single-width, elongate member 40, when viewed in end profile or in cross-section, is generally rectangular with rounded corners 42, with four grooved surfaces that are oriented at right angles to one another. Two such surfaces 44 face inwardly, into the framework 20, and two such surfaces 46 face outwardly. Each single-width, elongate member 40 is provided at each inwardly facing surface 44 with one undercut groove 48 and at each outwardly facing surface 46 with an undercut groove 50. Each groove 48 has two open ends and is continuous between the ends. At each of its opposite ends, each single-width, elongate member 40 has a tapped hole 56, which accommodates the threaded shank of a machine screw 22.

Each double-width, elongate member 60, when viewed in end profile or in cross-section, is generally rectangular with rounded corners 62 with two comparatively wide, grooved surfaces 64, and with two comparatively narrow, grooved surfaces 66 oriented at right angles to the comparatively wide, grooved surfaces 64. One of the surfaces 64 and one of the surfaces 66 face inwardly, into the framework 20, and the other surfaces 64, 66, face outwardly. Each double-width, elongate member 60 is provided at each comparatively wide, grooved surface 64 with two parallel, undercut grooves 68. Each double-width, elongate member 60 is provided at each comparatively narrow, grooved surface 66 with an undercut groove 70. Each groove 68 has two open ends and is continuous between its open ends. At each of its opposite ends, each double-width, elongate member 60 has two parallel, tapped holes 74, each of which can accommodate the threaded shank of a machine screw 22.

Preferably, each corner connector 80, 110, is machined from an aluminum block, which is a rectangular solid before machining. The aluminum block may be cast as a block or may be cut from a bar having a square or rectangular cross section. Each corner connector 80, 110, may be alternatively molded from an engineering polymer.

Figure 9:
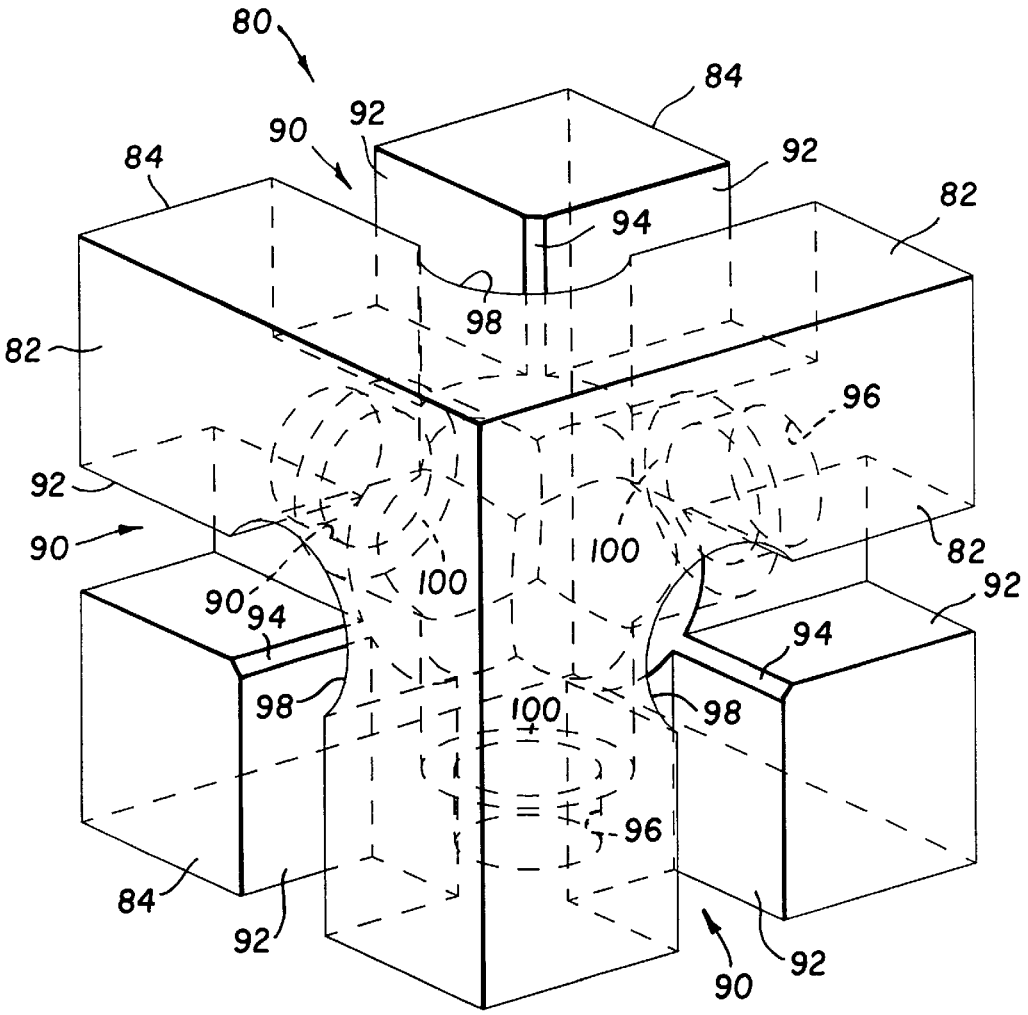
FIG. 9 is a perspective view of a joint connector of a first type used in the framework of the light-tight enclosure.
Figure 10:
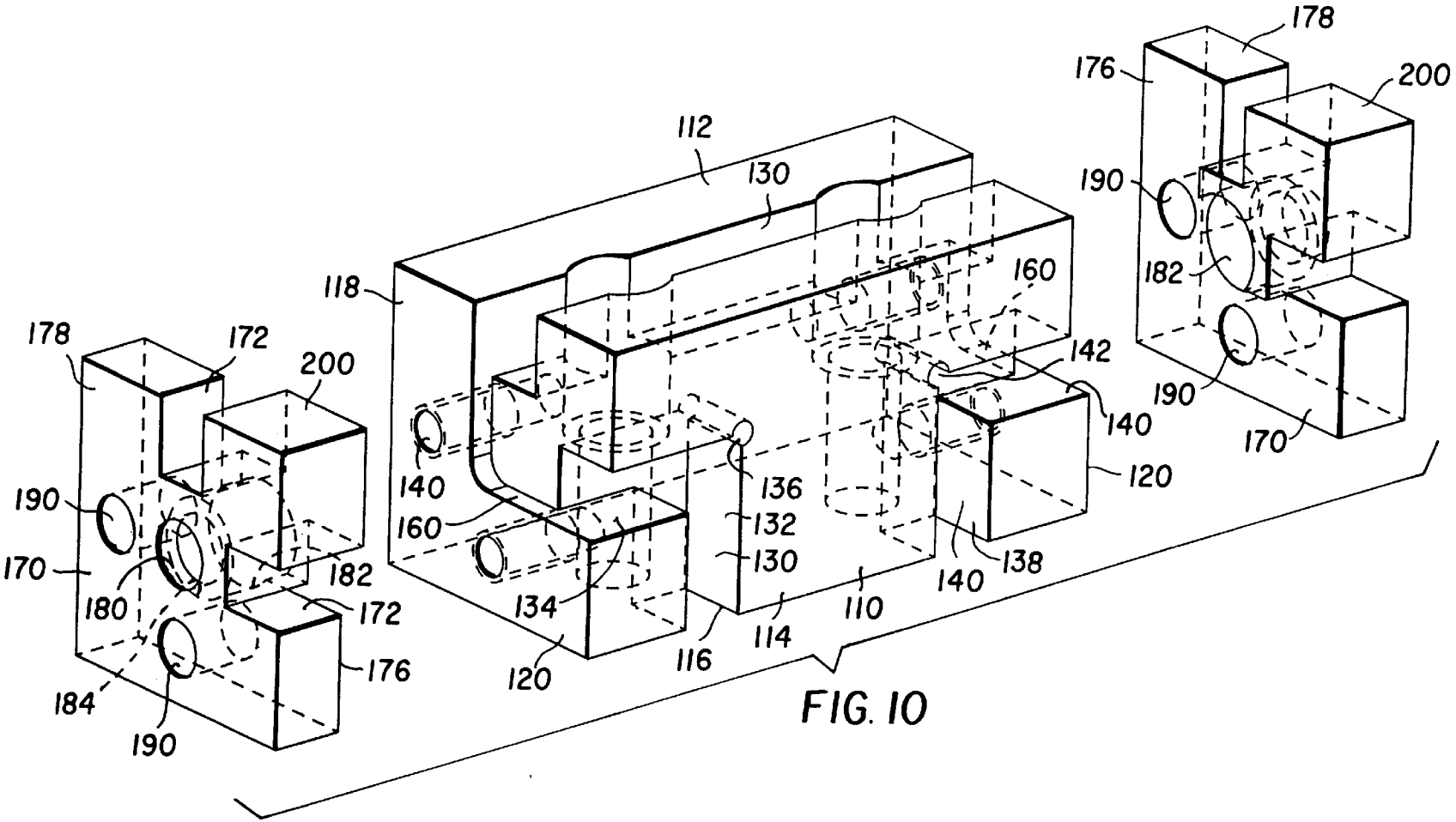
FIG. 10 is a perspective view of a joint connector of a second type used in the framework of the light-tight enclosure, along with two associated spacers.

As shown in FIG. 9, each corner connector 80 may be suitably employed at an outside corner of the framework 20 to join three single-width, elongate members 40 extending at right angles to one another. Each corner connector 80 has a generally cubical shape with three outwardly facing, grooved surfaces 82 oriented at right angles to one another and facing outwardly and with three inwardly facing, opposite surfaces 84. Each corner connector 80 is provided at each grooved surface 82 with a groove 90 having two branches 92 merging at a right-angled corner 94. The groove 90 has two open ends, one at each branch 92, and is continuous between the open ends. At each grooved surface 82, each corner connector 80 has a bore 96 opening at the opposite surface 84 and a counterbore 98 opening at such grooved surface 82 and terminating at an annular shoulder 100 around the bore 96. The counterbore 98 encompasses the right-angled corner 94. The bore 96 and the counterbore 98 to accommodate a machine screw 22 with its threaded shank passing through the bore 96 and threaded into the tapped hole 56 at an adjacent end of an elongate member 40 joined to such corner connector 80 and with its head bearing against the annular shoulder 100.

Each edge connector 110 may be suitably employed along an edge of the framework 20 to join two single-width, elongate members 40 and one double-width, elongate member 60 so that the single-width, elongate members 40 are aligned with the same axis and so that the double-width, elongate member extends at right angles to the single-width, elongate members. Each edge connector 110 is shaped generally as a rectangular solid with a first grooved surface 112, a second grooved surface 114 oriented at a right angle to the first grooved surface 112, a surface 116 opposite to the first grooved surface 112, a surface 118 opposite to the second grooved surface 114, and two opposite ends 120. Each edge connector 110 is provided at its first grooved surface 112 with a first groove 130. The first groove 130 has two open ends and is straight between its open ends. Each edge connector 110 is provided at its second grooved surface 114 with a second groove 132 having two branches 134 merging at a right-angled corner 136 and with a third groove 138 having two branches 140 merging at a right-angled corner 142. Each of the second and third grooves 132, 138, has two open ends, one at the connector surface 116 opposite to the first grooved surface 112 and another at a respective one of the opposite ends 120. At each of the opposite ends 120, each edge connector 110 has two tapped holes 140, each of which accommodates the threaded shank of a machine screw 22, and a recess 160.

Two spacers 170 are associated with each edge connector 110, one at each end 120 of such edge connector 110. Each spacer 170 has a profile similar to the profile of such edge connector 110 and has two grooves 172. Each spacer 170 is interposed between such edge connector 110 and a single-width, elongate member 40 so that each of the grooves 172 of each spacer 170 is aligned with one of the grooves 50 of such member 40. Thus, one such groove 172 of each spacer 170 is aligned with the first groove 130 of the associated connector 110 and the other groove 172 of such spacer 170 is aligned with the second groove 132 of the associated connector 110. The spacers 170 must be joined to the elongate members 40, as explained below, before the spacers 170 are joined to the associated connectors 110.

Each spacer 170 has an inner surface 176, which bears against the associated connector 110, and an outer surface 178, which bears against the elongate member 40 joined via such spacer 170. Each spacer 170 has a primary bore 180 opening at the outer surface 178 and a counterbore 182 opening at the inner surface 176 and terminating at an annular shoulder 184 around the bore primary 180. The primary bore 180 and the counterbore 182 accommodate a machine screw 22 with its threaded shank passing through the bore 186 and threaded into the tapped hole 56 at an adjacent end of such member 40 with its head bearing against the annular shoulder 184 to join such spacer 170 to such member 40. Each spacer 170 also has two secondary bores 190, each being aligned with one of the tapped holes 140. Each secondary bore 190 accommodates a machine screw 22 with its threaded shank passing through such bore 190 and threaded into one of the tapped holes 140 of the associated connector 110 via such spacer 170 and with its head bearing against the outer surface 178 of such spacer 170. When the machine screw 22 passing through each secondary bore 190 is threaded into the tapped hole 140 aligned with such primary bore 180, access for a suitable tool (not shown) for driving the machine screw 22 is provided by one of the grooves 48 at the inwardly facing surfaces 44 of the elongate member 40 joined to such spacer 170. Each spacer 170 has a widened portion 200, which fits into the recess 160 at the adjacent end 120 of the associated connector 110.

Preferably, each spacer 170 is machined from an aluminum block, which is a rectangular solid before machining. The aluminum block may be cast as a block or may be cut from a bar having a square or rectangular cross section. Each spacer 170 may be alternatively molded from an engineering polymer.

Figure 3:
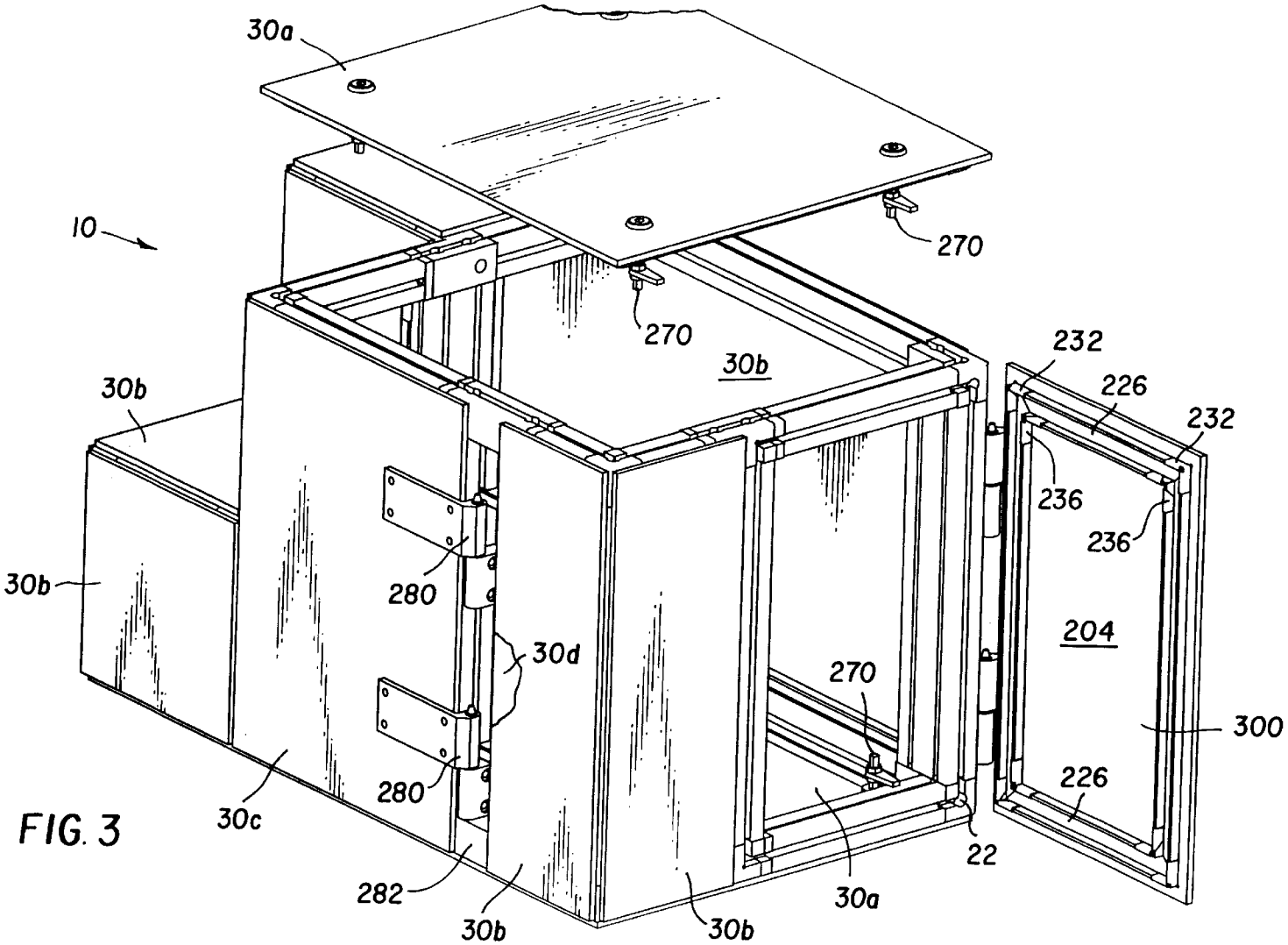
FIG. 3 is a partially exploded, partly broken away, perspective view of the light-tight enclosure, as seen from a third vantage.
Figure 7:
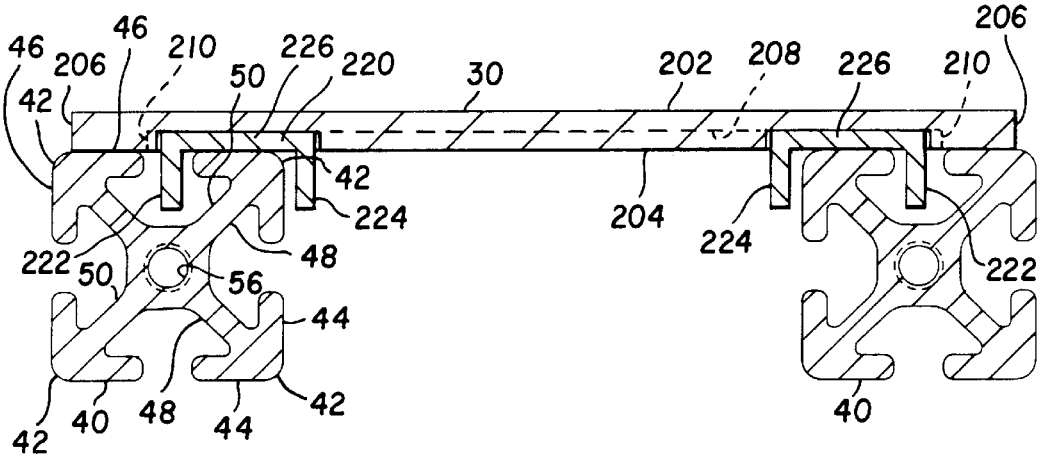
FIG. 7 is a sectional view taken along line 7—7 of FIG. 2, in a direction indicated by arrows, through two single-width, elongate members and one panel with its projecting ribs.
Figure 8:
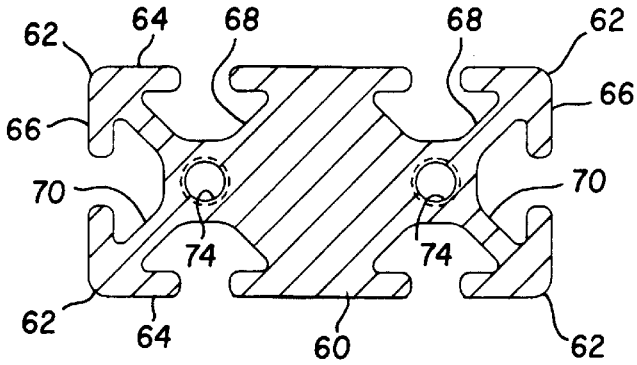
FIG. 8 is a sectional view taken along line 8—8 of FIG. 5, in a direction indicated by arrows, through a double-width, elongate member.

As shown in FIGS. 3 and 7, each panel 30 is fabricated from a metal sheet, such as an aluminum sheet, so as to have a outer, expansive surface 202, a inner, expansive surface 204, an outer margin 206, and a rectangular recess 208 at the inner, expansive surface 204. The rectangular recess 208 has an outer margin 210 spaced inwardly from the outer margin 206 of such panel 30. A metal channel 220, such as an aluminum channel, is mounted adhesively within the recess 208, near the outer margin 210 of the recess 208, to define an outer, continuously extending rib 222 projecting from the inner surface 204 and an inner, continuously extending rib 224 projecting from the inner surface 204. Each rib 222, 224, has a generally rectangular outline with four corners. The metal channel 220 is fabricated from four straight portions 226 having mitered ends, which define a right-angled corner of the outer rib 222 at each corner and which define a right-angled corner of the inner rib 224 at each corner.

As shown in FIG. 3, the metal channel 220 is wrapped at each corner with a sheet metal piece 232 applied adhesively to cover the right-angled corners of the outer rib 222 and with a sheet metal piece 236 applied adhesively to cover the right-angled corners of the inner rib 224, whereby such rib corners are caused to be light-tight. Additionally, or if the sheet metal pieces 232, 236, are omitted, a suitable sealant, such as a silicone sealant, is applied along the mitered ends to cause such rib corners to be light-tight.

When each panel 30 is mounted to the framework 20, such panel 30 is framed by certain of the elongate members 40, 60, and by whichever of the joint connectors 80, 110, join the elongate members 40, 60, that frame such panel 30. Certain of the outwardly opening grooves of such members 40, 60, and certain of the outwardly opening grooves 50, 68, 70, of such connectors 80, 110, define a continuously extending groove, by which the outer rib 222 of such panel 30 is received. The continuously extending groove has four right-angled corners, each being a right-angled corner of one of the grooves 50, 68, 70, of one of such connectors 80, 110. Each of the right-angled corners of the outer rib 222 of such panel 30 is received by one of the right-angled corners of the continuously extending groove. The inner rib 224 of such panel 30 projects along one of the inwardly facing surfaces 44, 66, of each of the elongate members 40, 60, that frame such panel 30. The outer rib 222 of such panel 30, the continuously extending groove, and the inner rib of such panel 30 define a labyrinth-type light lock.

Figure 4:
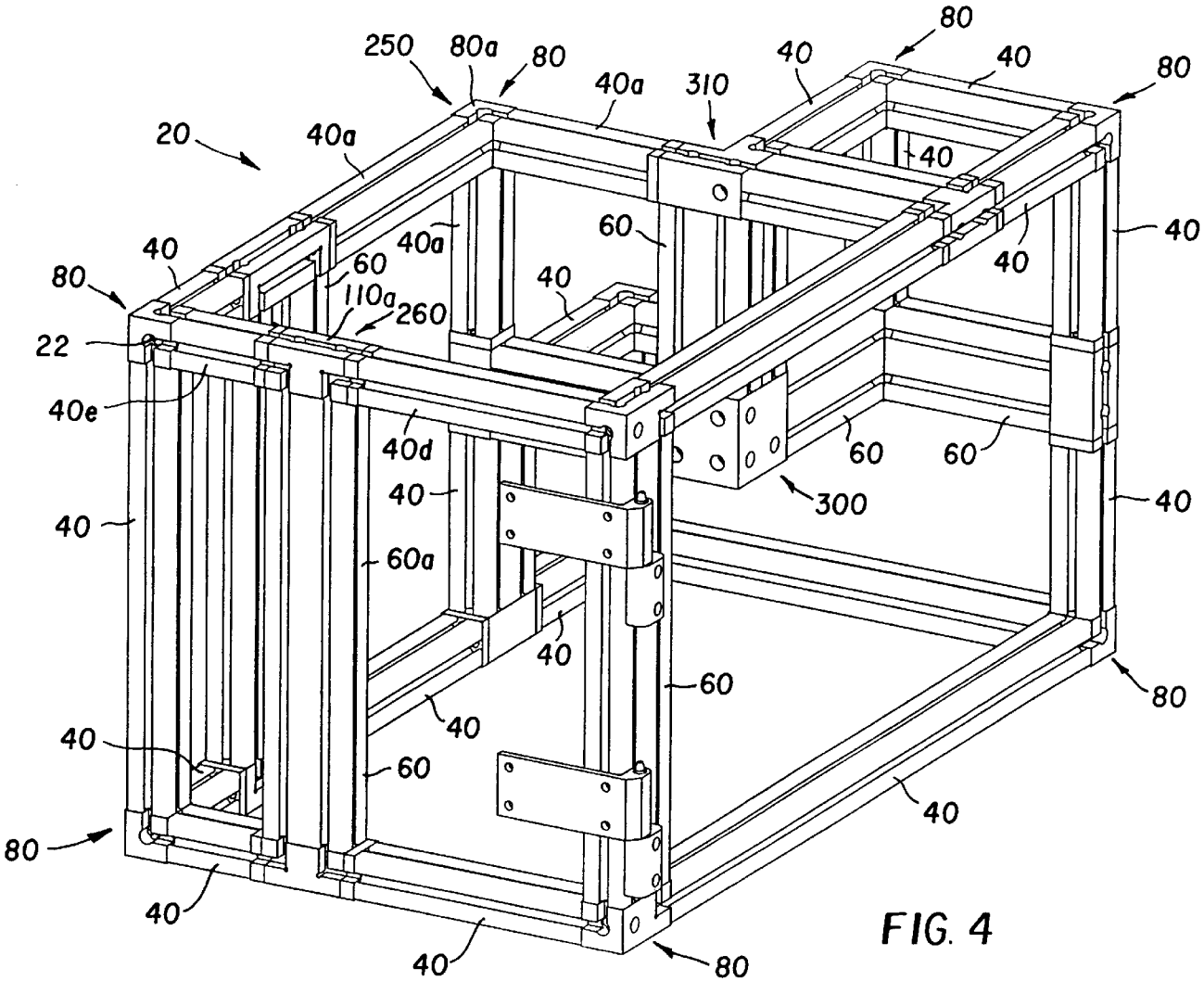
FIGS. 4, 5, and 6 are perspective views of the framework of the light-tight enclosure, as seen from the first vantage, from the second vantage, and from the third vantage respectively.
Figure 5:
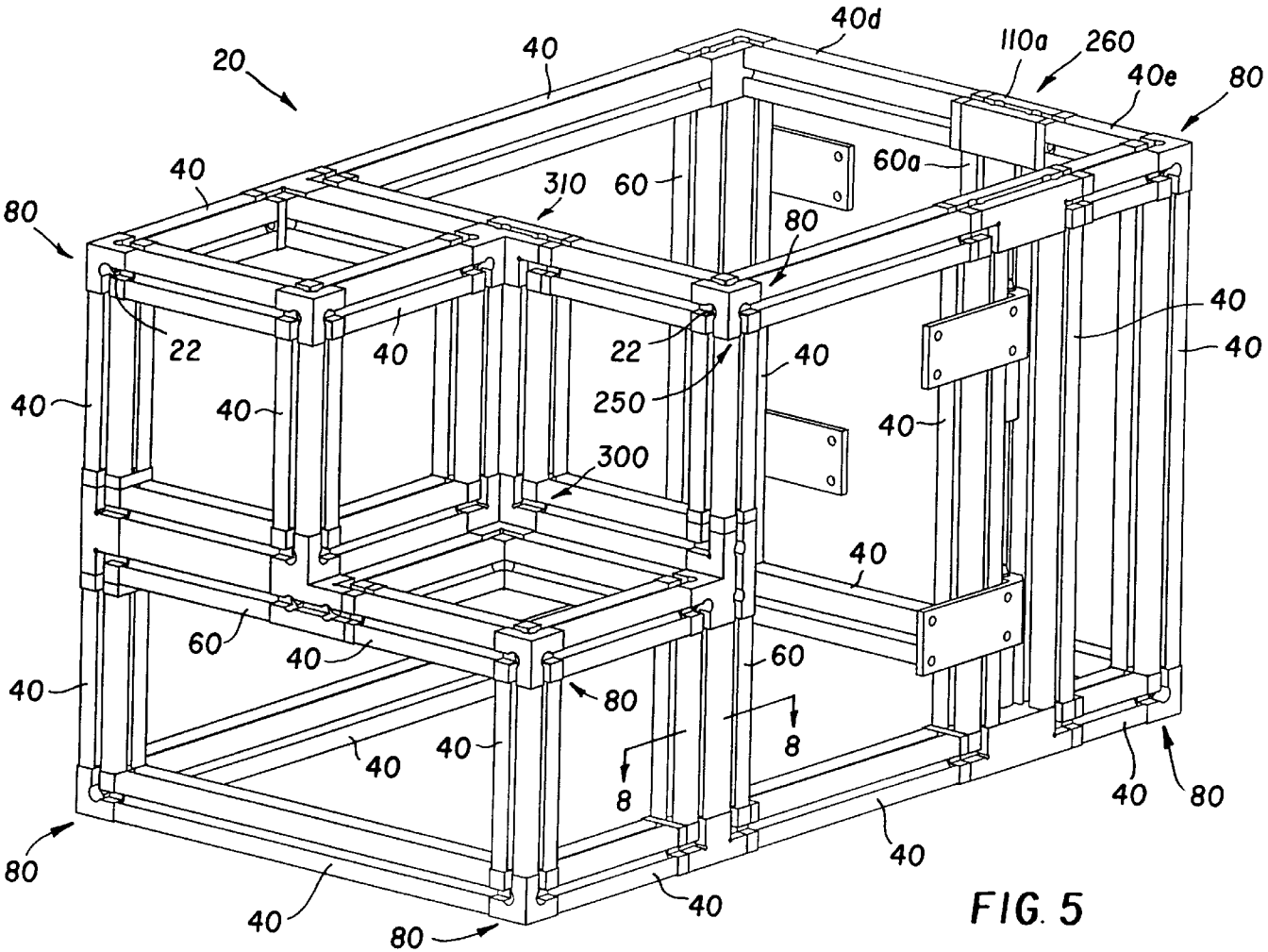
Figure 6:
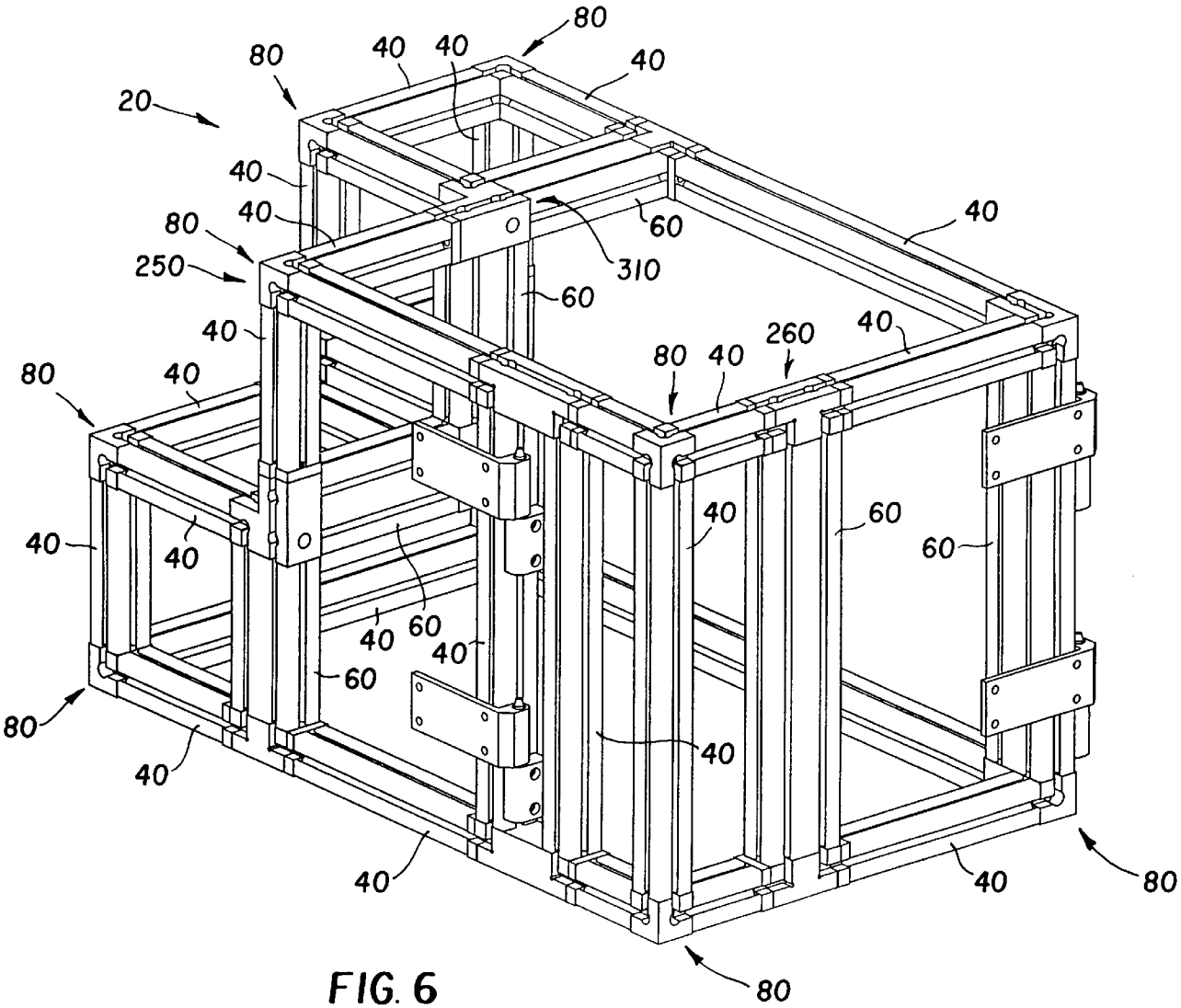

As an example, when the framework 20 is assembled at a joint 250 (see FIGS. 4, 5, and 6) where three elongate members 40*a* and a corner connector 80*a* are joined, certain of the grooves 50 of the elongate members 40*a* and one of the grooves 90 of the corner connector 80*a*, along each of the outwardly facing surfaces 82 of the corner connector 80*a*, define a continuously extending groove having a right-angled corner 94. Moreover, the outer rib 222 of an associated panel 30 is received by the continuously extending groove, while one of the right-angled corners of the outer rib 222 of the associated panel 30 is received by the right-angled corner 94 of the continuously extending groove. Further, the inner rib 224 of the associated panel 30 projects along one of the inwardly facing surfaces 44 of two of the elongate members 40*a*.

As another example, when the framework is assembled at a joint 260 (see FIGS. 4, 5, and 6) where a first, single-width, elongate member 40*d*, a second, single-width, elongate member 40*e*, and a third, double-width, elongate member 60*a*, and an edge connector 110*a* are joined, one groove 50 of the first elongate member 40*d*, one groove 68 of the second elongate member 40*e*, and the first groove 130 of the edge connector 110*a* merge with one another to define a first continuously extending groove having a straight portion adapted to receive a straight portion 226 of the outer rib 222 of a first panel 30, which is mounted to the framework 20 at the joint, as shown in FIG. 3 and described below. Moreover, another groove 50 of the second elongate member 40*e*, one groove 68 of the third elongate member 60*a*, and the second groove 132 of the edge connector 110*a* merge with one another so as to define a second continuously extending groove having a right-angled corner adapted to receive a right-angled corner of the outer rib 222 of a second panel 30 when is mounted to the framework 20 at the joint, as shown in FIG. 3 and described below. Furthermore, another groove 50 of the first elongate member 40*d*, another groove 68 of the third elongate member 60*a*, and the third groove 138 of the edge connector 110*a* merge with one another so as to define a third continuously extending groove having a right-angled corner adapted to receive a right-angled corner of the outer rib 222 of a third panel 30, which is mounted to the framework 20 at the joint, as shown in FIG. 3 and described below.

As shown in FIG. 3, the panels 30 are mounted to the framework 20 in various ways. The panels that are designated as panels 30*a* in FIG. 3 are mounted to the framework 20 via quarter-turn fasteners 270 of a known type. The panels that are designated as panels 30*b* in FIG. 3 are mounted to the framework 20 via screws (not shown) or other fasteners or adhesively. The panels that designated as panels 30*c* in FIG. 3 are mounted to the framework via hinges 280 of a known type so as to serve as doors. As shown in the drawings, the panels 30*a*, 30*b*, 30*c*, are mounted to exterior surfaces of the framework 20, whereas the panel that is designated as a panel 30*d* is mounted, as the panels 30*b* are mounted, to interior surfaces of the framework 20 so as to cover a hinge recess 282 defined between two vertically extending, single-width, elongate members 40.

As exemplified by the joint connectors 300, 310 (see FIGS. 4, 5, and 6) other joint connectors similar conceptually to the joint connectors 80, 110, but differing in their shapes, dimensions, and proportions and in their arrangements of bores and counterbores are provided at an inside corner (where the joint connector 310 is provided) and other joints of the elongate members 40, 60, of the framework 20. Advantageously, therefore, the size and configuration of the light-tight enclosure 10 can be varied to suit a wide range of applications.

Various other modifications may be made without departing from the scope and spirit of this application.

I claim:

1. A light-tight enclosure comprising a framework and panels mounted to the framework, the framework comprising elongate members and joint connectors including corner connectors, wherein each panel has an expansive surface, a continuously extending inner rib projecting from the expansive surface, and a continuously extending outer rib projecting from the expansive surface with each rib having a right-angled corner, each elongate member has two opposite ends and a generally rectangular profile with two outwardly facing surfaces and two inwardly facing surfaces and is provided at each of its outwardly facing surfaces with a groove, which is open ended and which extends continuously between the opposite ends of said elongate member, and each corner connector has three outwardly facing surfaces and is provided at each of its outwardly facing surfaces with a continuously extending groove, which is open-ended and which has a right-angled corner, and wherein the enclosure is assembled at each corner connector so that three said elongate members extend at right angles to one another and are joined to said corner connector, the grooves of said three elongate members receive the outer ribs of three said panels, the right-angled corners of the grooves at the outwardly extending surfaces of said corner connector receive the right-angled corners of the outer ribs of said three panels, and the inner ribs of said three panels project along the inwardly facing surfaces of said three elongate members.

2. The light-tight enclosure of claim 1 wherein each elongate member is an extruded member.

3. A light-tight enclosure comprising a framework and panels mounted to the framework, the framework comprising elongate members and joint connectors including an edge connector, wherein each panel has an expansive surface, a continuously extending inner rib projecting from the expansive surface, and a continuously extending outer rib projecting from the expansive surface with each rib having a straight section and a right-angled corner, each elongate member has two opposite ends and a generally rectangular profile with two outwardly facing surfaces and two inwardly facing surfaces and is provided at each of its outwardly facing surfaces with a groove extending continuously between the opposite ends, the edge connector having a first grooved surface and a second grooved surface at a right angle to the first grooved surface, the edge connector is provided at its first grooved surface with a first continuously extending groove, which is open-ended and straight, the edge connector is provided at its second surface with a continuously extending second groove, which is open-ended and which has a right-angled corner, the edge connector being provided at its second surface with a continuously extending third groove, which is open-ended and which has a right-angled corner, and wherein the enclosure is assembled at the edge connector at a joint where a first and a second of the elongate members are joined to the edge connector and are aligned and where a third of the elongate members is joined to the edge connector and extends at right angles to the first and second elongate members, so that grooves of the first and second elongate members and the first groove of the edge connector receive the straight section of the outer rib of a first of the panels, the right-angled corners of the second and third grooves of the edge connector receive the right-angled corners of the outer ribs of a second and a third of the panels, and the inner ribs of the first, second, and third panels project along the inwardly facing surfaces of the first, second, and third elongate members.

4. The light-tight enclosure of claim 3 wherein each elongate member is an extruded member.

5. The light-tight enclosure of claim 3 wherein the first groove has two branches merging at the right-angled corner of the first groove, wherein the second groove has two branches merging at the right-angled corner of the second groove, and wherein the framework includes a first spacer interposed between the first elongate member and the edge connector and a second spacer interposed between the second elongate member and the edge connector, the first spacer being provided with a groove aligned with the first groove and being provided with a groove aligned with one branch of the second groove, the second spacer being provided with a groove aligned with the first groove and being provided with a groove aligned with one branch of the third groove.

6. The light-tight enclosure of claim 5 wherein each elongate member is an extruded member.

7. A joint connector useful as a corner connector in a framework of a light-tight enclosure, wherein the joint connector has three outwardly facing surfaces oriented at right angles to one another, each outwardly facing surface being provided at each of its outwardly facing surfaces with a continuously extending groove, each groove being open-ended and having a right-angled corner.

8. The joint connector according to claim 7 wherein each continuously extending groove has two branches merging at the right-angled corner.

9. The joint connector according to claim 8 wherein each continuously extending groove is open-ended between two open ends, one at each branch.

10. A joint connector useful as an edge connector in a framework of a light-tight enclosure, wherein the joint connector has a first grooved surface and a second grooved surface at a right angle to the first grooved surface, the joint connector is provided at its first grooved surface with a first continuously extending groove, which is open-ended and straight between two open ends, the joint connector is provided at its second grooved surface with a continuously extending second groove, which is open-ended and which has a right-angled corner between two separated open ends at two adjacent edges of the second grooved surface, and the joint connector is provided at its second grooved surface with a continuously extending third groove, which is open-ended and which has a right-angled corner between two separated open ends at two adjacent edges of the second grooved surface.

* * * * *

UNITED STATES PATENT AND TRADEMARK OFFICE

CERTIFICATE OF CORRECTION

PATENT NO. : 5,848,500
DATED : December 15, 1998
INVENTOR(S) : Duane B. Kirk

It is certified that error appears in the above-identified patent and that said Letters Patent is hereby corrected as shown below:

| | |
|---|---|
| Column 8, Line 39 | -- The light-tight enclosure of claim 3 wherein the second -- |
| Column 8, Line 41 | -- of the second groove, wherein the third groove has two -- |
| Column 8, Line 42 | -- branches merging at the right-angled corner of the third -- |
| Column 8, Line 60 | -- a continuously extending groove, extending from one edge to an adjacent edge of each said outwardly facing surface, each groove being open- -- |
| Column 8, Line 61 | -- ended and having a right-angled corner between two separated open ends. -- |
| Column 8, Line 67 | -- open ends, each one of said open ends being located at each branch. -- |

Signed and Sealed this

Twenty-seventh Day of April, 1999

*Attest:*

Q. TODD DICKINSON

*Attesting Officer*

*Acting Commissioner of Patents and Trademarks*